US006986220B2

(12) United States Patent
Kaulbach

(10) Patent No.: US 6,986,220 B2
(45) Date of Patent: Jan. 17, 2006

(54) VISUAL DISPLAY ATTACHMENT TO SKI LIFT EQUIPMENT

(75) Inventor: Nicholas R. M. Kaulbach, Westmount (CA)

(73) Assignee: SpinVision, Montréal (CA)

( * ) Notice: Subject to any disclaimer, the term of this patent is extended or adjusted under 35 U.S.C. 154(b) by 0 days.

(21) Appl. No.: 10/438,022

(22) Filed: May 15, 2003

(65) Prior Publication Data

US 2003/0213155 A1 Nov. 20, 2003

(30) Foreign Application Priority Data

May 17, 2002 (CA) ..... 2386768

(51) Int. Cl.
*G09F 11/02* (2006.01)

(52) U.S. Cl. ..... 40/506; 40/320; 40/660

(58) Field of Classification Search ..... 40/111, 40/114, 115, 320, 493, 506, 606.15, 607.03, 40/611.01, 611.03, 611.05, 660, 661, 661.12, 40/606.1, 665; 116/309

See application file for complete search history.

(56) References Cited

U.S. PATENT DOCUMENTS

| | | | | | |
|---|---|---|---|---|---|
| 2,296,551 | A | * | 9/1942 | Ylio | 40/112 |
| 2,916,837 | A | * | 12/1959 | Bosland | 40/114 |
| 2,918,741 | A | | 12/1959 | Welter et al. | |
| 3,738,037 | A | | 6/1973 | Daley | |
| 3,829,994 | A | * | 8/1974 | Dillon | 40/634 |
| 4,164,084 | A | * | 8/1979 | Crockett | 40/660 |
| 4,164,910 | A | | 8/1979 | Feiler | |
| 4,182,059 | A | | 1/1980 | Greene | |
| 4,408,406 | A | | 10/1983 | Barton | |
| 4,513,983 | A | | 4/1985 | Calder | |
| 4,636,271 | A | | 1/1987 | Gandolfo | |
| 4,876,810 | A | | 10/1989 | Piana et al. | |
| 5,080,516 | A | * | 1/1992 | Ward | 400/717 |
| 5,116,204 | A | * | 5/1992 | Power et al. | 40/606.14 |
| 5,183,193 | A | | 2/1993 | Brandell | |
| 5,301,443 | A | | 4/1994 | Gori | |
| 5,400,936 | A | | 3/1995 | Jones et al. | |
| 5,425,546 | A | | 6/1995 | Gerber et al. | |
| 5,430,974 | A | | 7/1995 | Hering | |
| 5,477,633 | A | | 12/1995 | Leinberger | |
| 5,511,850 | A | | 4/1996 | Coursey | |
| D372,499 | S | | 8/1996 | Carlson et al. | |
| 5,556,162 | A | | 9/1996 | Raffini | |
| 5,685,095 | A | * | 11/1997 | DeMasi | 40/320 |
| 6,212,809 | B1 | * | 4/2001 | Gaule | 40/660 |

* cited by examiner

*Primary Examiner*—Brian K. Green
(74) *Attorney, Agent, or Firm*—Shlesinger, Arkwright & Garvey LLP

(57) ABSTRACT

An information display device adapted to be mounted on the safety bar of a ski-lift chair. The device has a tubular base which is rigidly attached to the safety bar. A tubular carrier is rotatabley secured to the tubular base. This tubular carrier provides a cylindrical support surface for information to be displayed. A tubular cover is mounted about the carrier and fixed to the tubular base to protect the tubular carrier and the information attached to it.

11 Claims, 6 Drawing Sheets

VISUAL DISPLAY ATTACHMENT TO SKI LIFT EQUIPMENT

BACKGROUND OF THE INVENTION

1. Field of the Invention

This invention is directed toward an information display device adapted to be mounted on a cylindrical support such as a bar. The invention is particularly directed toward a display device for mounting on the safety bar of a ski-lift chair.

2. Description of the Related Art

Display devices rotatably mounted on cylindrical bars are known. One such known device, mounted on the safety bar of a ski-lift chair, is shown by U.S. Pat. No. 5,685,095.

However, the known display devices are not well constructed to protect the information being displayed against the elements, such as blizzards. Further, the known devices are not very securely mounted to prevent tampering with the device and/or with the information carried by the device.

SUMMARY OF THE INVENTION

The purpose of the present invention is to provide an information display device that: protects the information to be displayed against tampering and the elements; is easy to rotate about the cylindrical support, even with ski mitts, to display all the information carried by the device; is rugged in construction and securely mounted, and yet makes it easy to change the information displayed.

The display device of the present invention has a mounting base that is securely mounted on a support so as to prevent easy removal of the device. The display device has an information carrier rotatably mounted on the base, with the carrier provided with large, accessible, rotation means that can be operated to rotate the carrier on the base even by a person wearing ski mitts. The device presents information on the carrier that is normally well protected from the elements, located under a cover and sealed from exposure to the elements. In a preferred embodiment, the cover is easily opened to allow the information on the carrier to be changed if desired.

The invention is particularly directed toward an information display device for mounting on a support, the device having a tubular base adapted to be fixedly mounted about the support and a tubular carrier rotatably mounted on the base. The carrier provides a support surface. Information is provided on or adjacent the support surface. A tubular cover is mounted about the carrier and fixed to the base, the cover protecting the information carried by the carrier. The cover has a transparent portion through which the information can be read. Rotation means are provided on the carrier for use in rotating the carrier about the base within the cover to move the information past the transparent portion of the cover.

DESCRIPTION OF THE PREFERRED EMBODIMENTS

Figure 1:
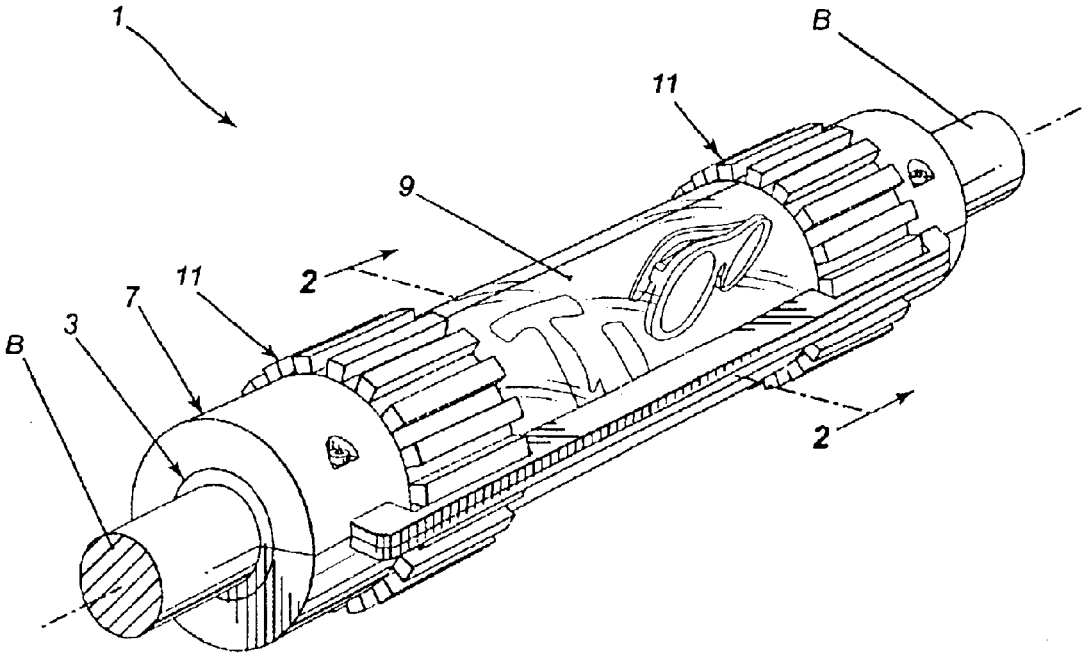
FIG. 1 is a perspective view of the device mounted on a safety bar on a ski-lift chair.
Figure 2:
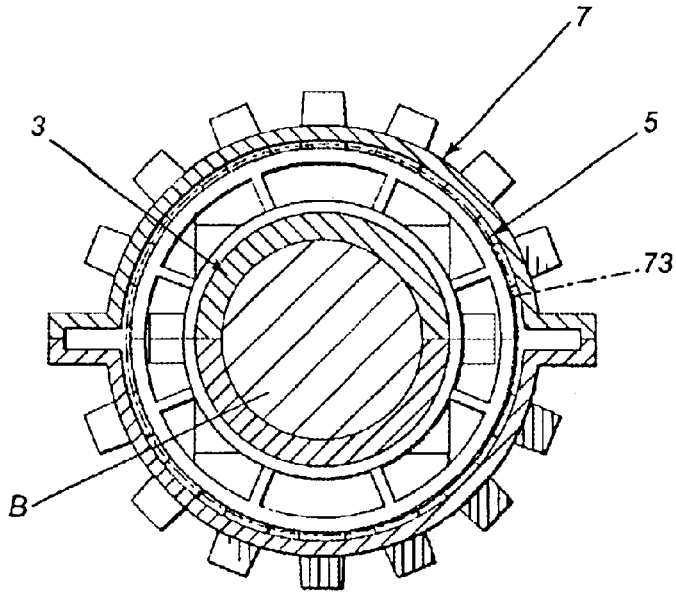
FIG. 2 is a cross-section view along line 2—2 in FIG. 1.

The display device 1 of the present invention, as shown in FIGS. 1 and 2, has a tubular base 3 that fixedly mounts onto a safety bar B on a ski-lift chair. The device includes a tubular carrier 5 that is rotatably mounted on the base 3, the carrier 5 carrying the information to be displayed by the device; and a tubular cover 7 overlying the carrier 5 to protect the information it carries, the cover 7 fixedly attached to the base 3. At least a portion 9 of the cover 7 is transparent to allow viewing of the information carried by the carrier 5. The device 1 includes rotation means 11 for rotating the carrier 5 about the base 3 to display all the information carried by it through the transparent portion 9 on the cover 7.

Figure 3:
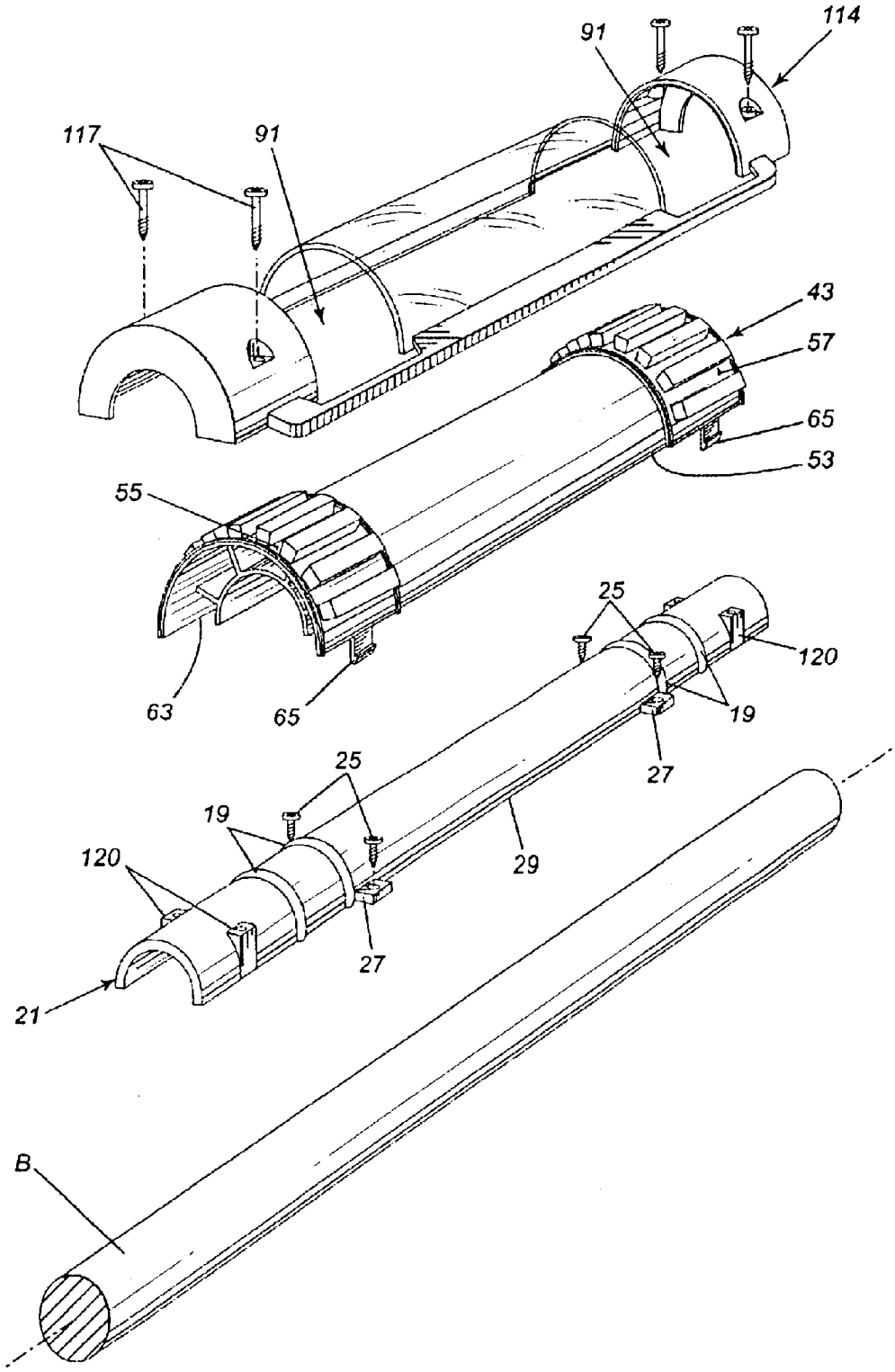
FIG. 3 is a partial, exploded perspective view of the device.
Figure 4:
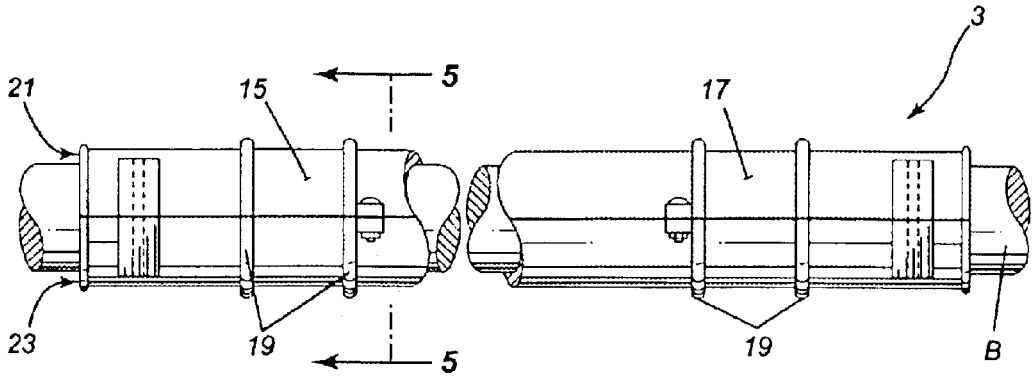
FIG. 4 is a front view with the base mounted on the bar.
Figure 5:
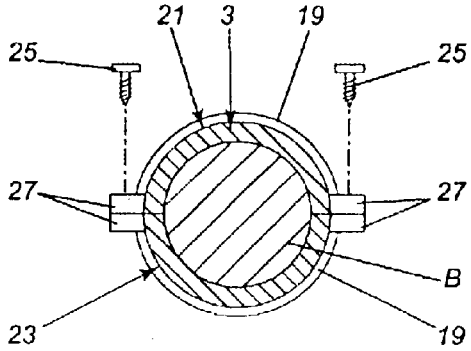
FIG. 5 is a cross-section view along line 5—5 in FIG. 4.

In more detail, as shown in FIGS. 3 to 5, the base 3 of the device 1 is in the form of an elongate, tubular member. A pair of spaced-apart guide tracks 15, 17 encircle the base 3. Each guide track 15, 17 is defined by a pair of spaced-apart guide ribs 19 encircling the base 3. The base 3 is formed from two, elongated, half-tubular, base members 21, 23 as shown in FIG. 4. These half base members 21, 23 are sized to fit snugly about the cylindrical safety bar B on a ski-lift chair to form the tubular base 3. Fastening means 25, in the form of bolts or the like, fasten the half base members 21, 23 tightly to each other about the bar B, to clamp the base 3, formed by the half members, to the bar B. The fastening means 25 pass through brackets 27 on the outer surfaces of the half members 21, 23, the brackets 27 adjacent the side edges 29 of the half members. The ribs 19, defining the guide tracks 15, 17, are half on one half base member 21 and half on the other half base member 23 and aligned when the half base members are joined together.

Figure 8:
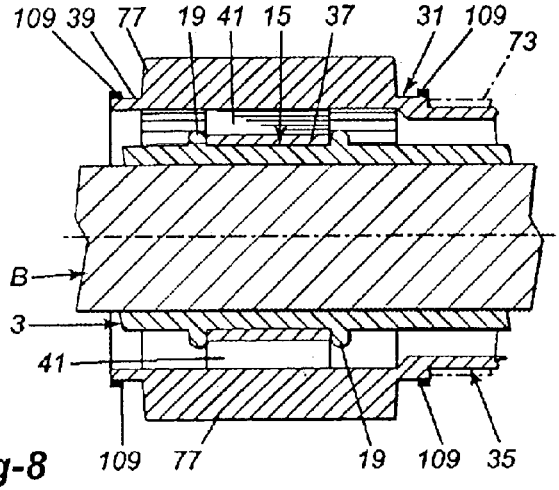
FIG. 8 is a cross-section view taken along line 8—8 in FIG. 6.

The carrier 5 of the device supports the information to be displayed by the device. The carrier 5, shown in FIGS. 3 and 6 to 8, is also an elongated tubular member and is rotatably mounted on the base 3. The carrier 5 has two spaced-apart ring sections 31, 33 joined by a central cylindrical wall 35. Each ring section 31, 33 has an inner circular wall 37 and an outer circular wall 39. The inner and outer circular walls 37, 39 are joined by radial braces 41. The outer wall 39 is wider than the inner wall 37, as shown in FIG. 8, and the cylindrical central wall 35 connects to the outer walls 39 of the ring sections 31, 33. The inner walls 37 of the ring sections 31, 33 ride in the guide tracks 15, 17 on the base 3 between the ribs 19 defining each track. The carrier 5 rotates easily on the guide tracks 15, 17.

Figure 6:
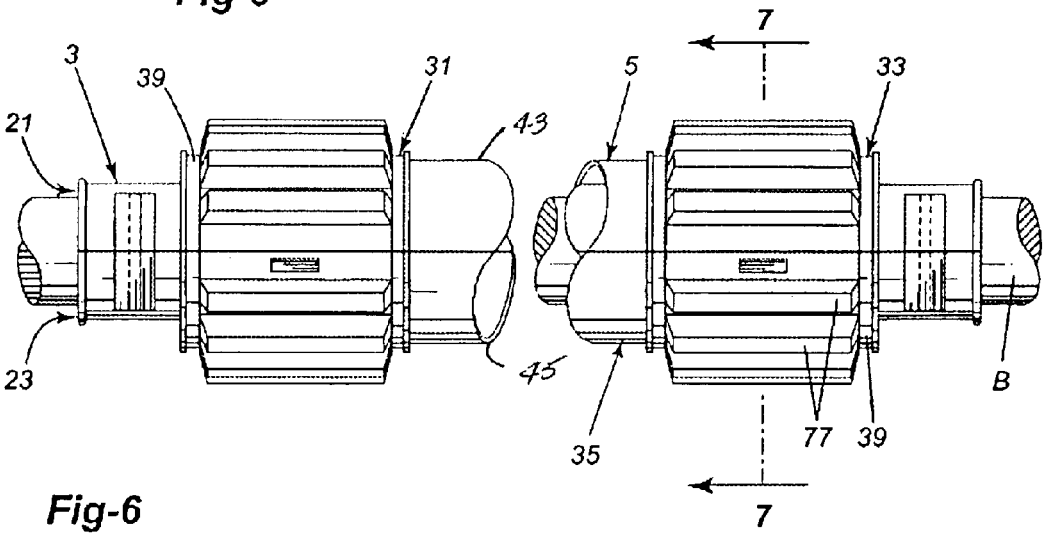
FIG. 6 is a front view with the carrier mounted on the base.
Figure 7:
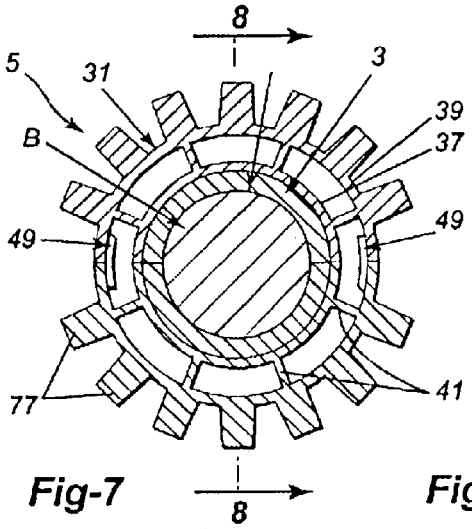
FIG. 7 is a cross-section view taken along line 7—7 in FIG. 6.
Figure 9:
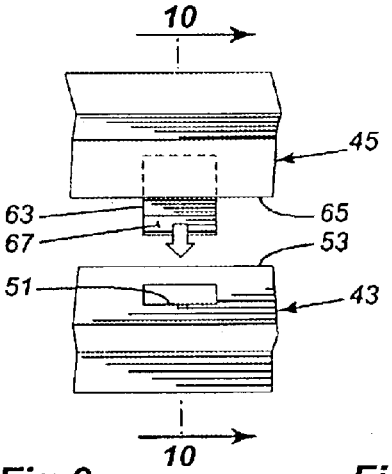
FIG. 9 is a detail front view showing the connecting means.
Figure 10:
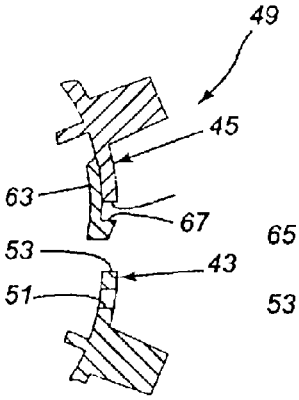
FIG. 10 is a detail cross-section view of the carrier showing the connecting means.
Figure 11:
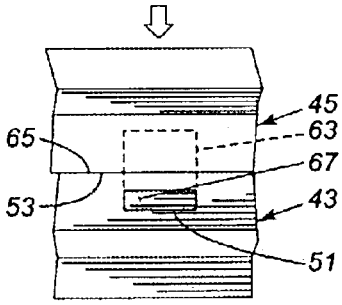
FIG. 11 is a view similar to FIG. 9 with the covers closed.

The carrier 5 is formed from two half carrier sections 43, 45, as shown in FIG. 6, allowing the carrier 5 to be mounted about the base 3. Detachable connecting means 49 are provided on the half carrier sections 43, 45 for detachably connecting them together about the base 3. The connecting means 49, as shown in FIGS. 9 to 11, can comprise a slot 51 on each half ring section 55, 57 in each half carrier section 43, 45 adjacent one side 53 of the half carrier sections; and a tab 63 projecting from the other side 65 of the half carrier sections 43, 45 in the ring sections 55, 57. Each tab 63 carries a projection 67 on its outer surface sized to fit into a slot 51. The slots 51 on one side 53 of one half carrier section 43 receive the tabs 63 on the other side 65 of the other half carrier section 45. The slots 51 on the one side 53 of the other half carrier section 45 receive the tabs 63 on the other side 65 of the one half carrier section 43 to securely lock the half carrier sections 43, 45 together about the base 3 forming the carrier 5. While one form of connecting means has been described, other connecting means can be employed. The connecting means 49 allow the carrier to be changed, if needed.

The information carried by the carrier 5 can be printed on the outer surface of the central wall 35 of the carrier. Preferably, a separate information sheet 73, shown in dotted lines, made from paper or other suitable material, with the information printed thereon, can be mounted against the outer surface of the central wall 35 between the ring sections 31, 33.

The carrier 5 carries rotation means 11 for use in rotating the carrier on the base 3. The rotation means 11 can be the outer walls 39 of the ring sections 31, 33. Preferably, the rotation means 11 comprises spaced-apart, radially extending, lugs 77 on the outer surface of the outer walls 39, the lugs 77 extending parallel to the longitudinal axis of the bar B when the carrier 5 is mounted on the base 3 which in turn is mounted on the bar B.

A tubular cover 7 is mounted over the carrier 5 when it is mounted on the base 3, the cover 7 attached to the base 3. The cover 7, as shown in FIGS. 3 and 12 to 15, has two tubular end sections 81, 83 and a central tubular section 85. The end sections 81, 83 are spaced from the central section 85 and joined to the central section 85 by diametrically opposed side bars 87, 89. Top and bottom slots 91, 93 are formed between each end section 81, 83 and the central section 85, the slots 91, 93 located over and under the ring sections 31, 33 on the carrier 5. The end sections 81, 83 each have an end wall 95 with a central opening 99 therein through which the base 3 passes.

Sealing means 109 extend about both sides of the outer wall 39 of the ring sections 31, 33 on the carrier 5 and contact the inner edges 111 of the tubular end sections 81, 83 and the outer edges 113 of the tubular central section 85 sealing the interior the cover 7 from the elements.

Figure 12:
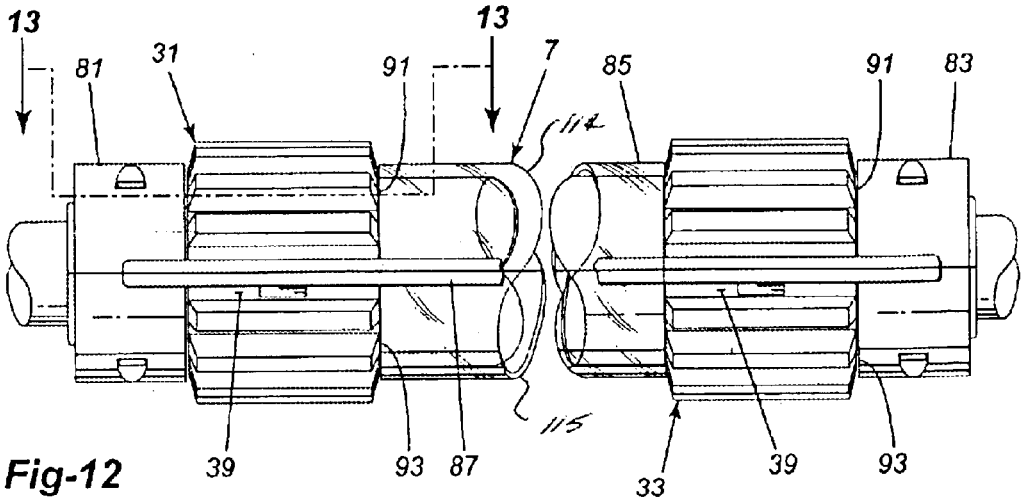
FIG. 12 is a front view of the cover mounted on the base.
Figure 13:
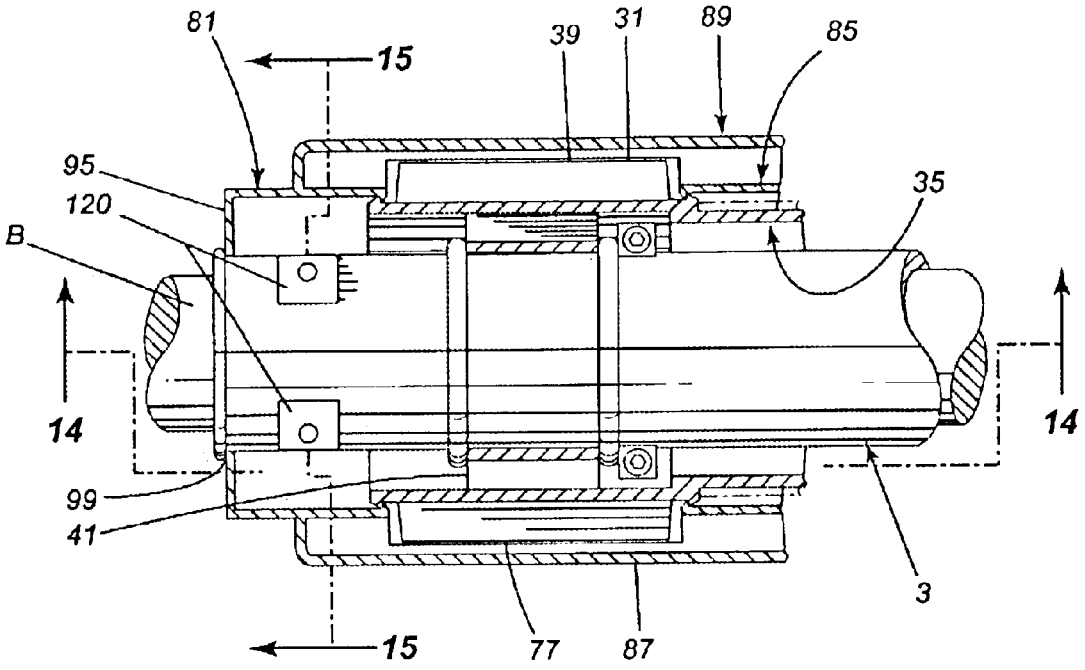
FIG. 13 is a cross-section view along line 13—13 in FIG. 12.
Figure 14:
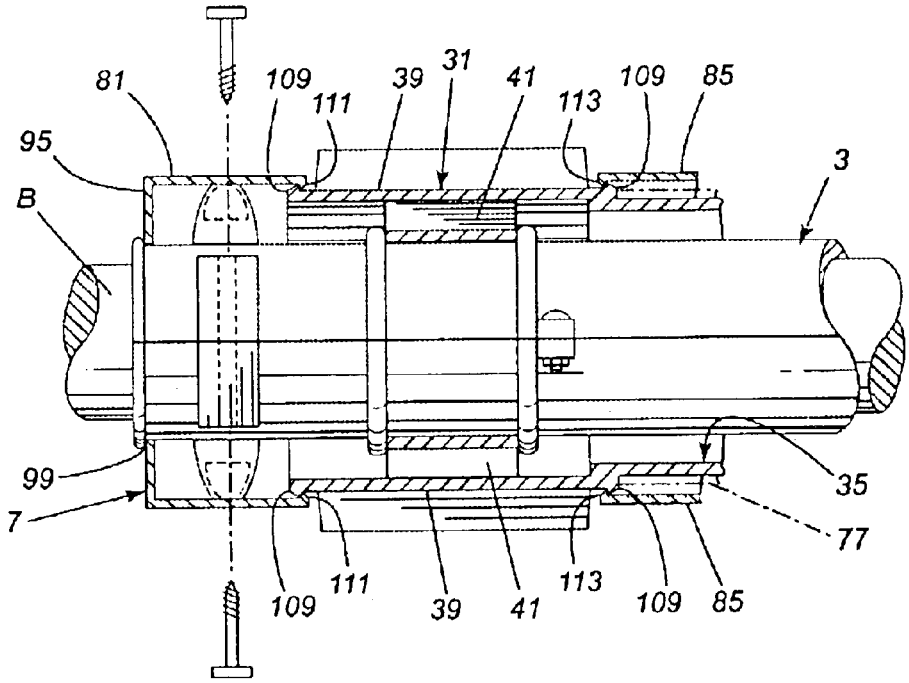
FIG. 14 is a cross-section view along line 14—14 in FIG. 13.
Figure 15:
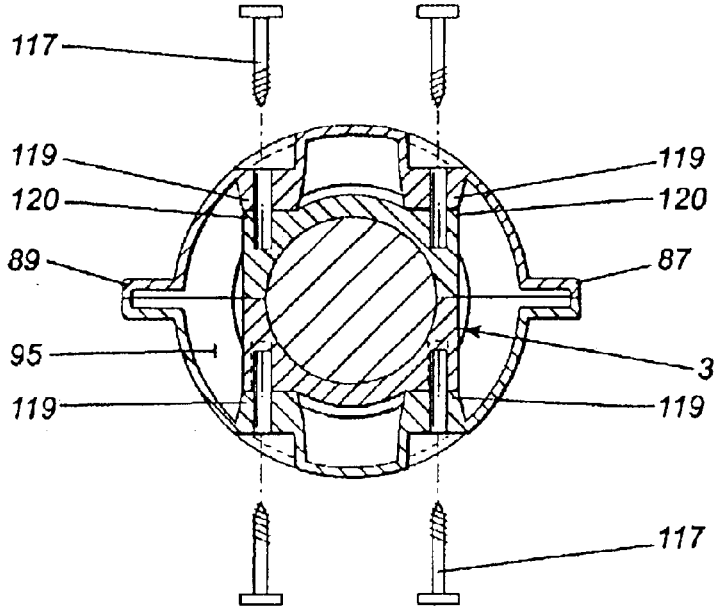
FIG. 15 is a cross-section view along line 15—15 in FIG. 13.
Figure 16:
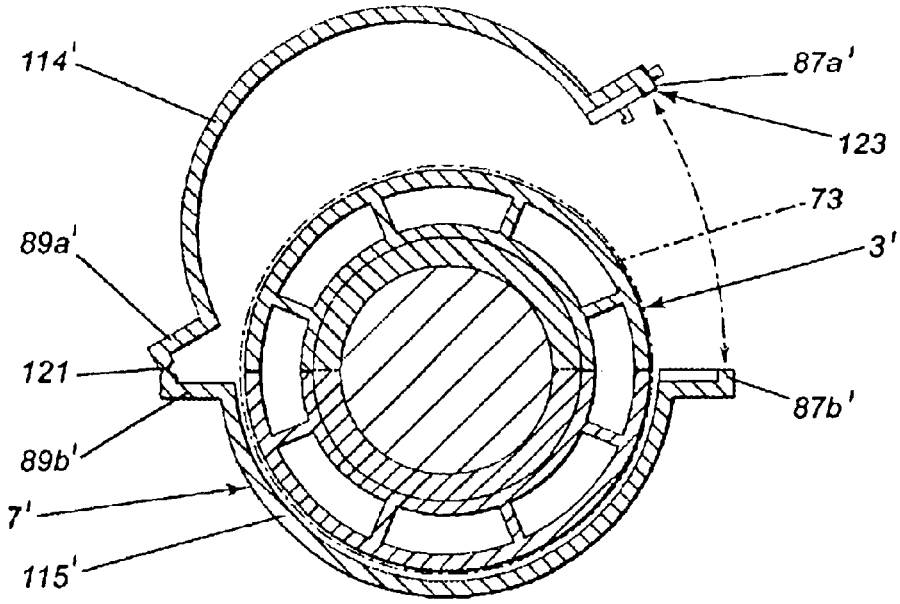
FIG. 16 is a view similar to FIG. 2 showing a modified cover.

The cover 7 is made in two parts 114, 115 to allow it to be mounted about the carrier 5 and the base 3 as shown in FIG. 12. The cover 7 is divided into the two parts midway between the side bars 87, 89. Each cover part 114, 115 is attached to the base 3 by fasteners 117 passing through brackets 119, in the areas forming the end sections 81, 83, into brackets 120 on the base 3. When attached to the base 3, the cover parts 114, 115 abut enclosing the carrier 5.

When the cover 7 is mounted on the base 3, the rotation means 11 on the carrier is accessible through the four slots 91, 93 in the cover so that the carrier 5 can be rotated on the base 3 under the cover 7. If the rotation means 11 comprise lugs 77 on the ring sections 31, 33 of the carrier 5, the lugs would normally project through the slots 91, 93 slightly above the cover 7 making it easier to rotate the carrier 5. The central section 85 of the cover 7 is spaced from the cylindrical wall 35 of the carrier 5, and the information that the wall carries. At least the top portion of the central section 85 in the cover 7, when mounted on the base 3, is transparent to provide the transparent portion 9 in the cover. This allows the information, carried by the carrier 5 under the cover 7, to be easily displayed to a person riding in the chair lift. The information can be moved past the transparent portion 9 of the cover 7 by operating the rotation means 11 to rotate the carrier 5 which carries the information.

In another embodiment of the invention only the bottom cover part 115' of the cover 7' is attached to the base 3' by fasteners. The top cover part 114' is hinged along one side bar section 89*a*' to the one side bar section 89*b*' of the attached, bottom cover part 115' by a hinge 121. When the cover parts 113', 115' are closed, the other side bar sections 87*a*', 87*b*' of the cover parts abut, and a suitable locking device 123 can detachably connect them together. This hinged cover 7' can be easily opened by unlocking the locking device 123 and pivoting the top cover part 113' open about the hinge 121. This allows the information sheet 73 to be easily changed.

The rotation means have been shown as two ring members. The device could operate with just a single ring member located to either side of the device, or with just a single ring in the middle of the device with information in two sections, one section on each side of the central ring member.

The device is not very large in diameter when installed on the safety bar allowing a skier to comfortably grip the bar and/or the device. The carrier can be easily rotated, particularly with the lugs, even when wearing mitts to display all the information. The information, when carried on an information sheet, can be easily changed when the cover is hinged yet cannot be easily vandalized when the cover is locked.

The information displayed can be in the form of advertising or it can provide information concerning the skiing center such as the type and location of ski trails and the location of ski lifts.

While the device has been described as being used in connection with a safety bar on a ski-lift, it could be used in other locations as well. For example, the device could be mounted on the handles of shopping carts to display information on specials available in the store.

I claim:

1. An information display device for mounting on a cylindrical support, the device having: a tubular base adapted to be fixedly mounted about the support, the base in two semi-cylindrical tubular parts and fastening means connecting the tubular parts together to form the base, the fastening means clamping the base to the support; a tubular carrier rotatably mounted on the base, the longitudinal axis of the carrier aligned with the longitudinal axis of the base and the carrier providing a cylindrical support surface for supporting information to be displayed; and a tubular cover mounted about the carrier and fixed to the base, the longitudinal axis of the cover aligned with the longitudinal axis of the base; the cover protecting any information supported by the carrier, the cover having a transparent portion through which the information could be read; and rotation means on the carrier for use in rotating the carrier, and any information supported by it, about the base past the transparent portion of the cover.

2. A display device as claimed in claim 1 wherein the base has spaced-apart guide means for supporting and locating the carrier thereon.

3. A display device as claimed in claim 2 wherein the carrier is in two parts and connecting means are provided for detachably connecting the two parts together about the base, the carrier having spaced-apart ring sections that ride on the guide means.

4. A display device as claimed in claim 3 wherein the cover is in two parts and connecting means are provided for connecting the two parts of the cover together, about the carrier, and to the base.

5. A display device as claimed in claim 4 wherein the cover has openings providing access to the ring sections on the carrier, the rotation means on the ring sections projecting through the openings.

6. A display device as claimed in claim 5 wherein the rotation means comprise radially extending lugs on the outer surface of the ring sections, the lugs extending above the cover.

7. A display device as claimed in claim 5 including sealing means between the ring sections and the cover about the openings to seal the information carried by the carrier from the elements.

8. A display device as claimed in claim 5 including sealing means between the ring sections and the cover about the openings to seal the information carried by the carrier from the elements.

9. A display device as claimed in claim 3 wherein the cover is in two parts and connecting means are provided for connecting one cover part to the base, the other cover part hinged to the one cover part on one side and lockable to the one cover part on the other side with locking means.

10. A display device as claimed in claim 9 wherein the cover has openings providing access to the ring sections on the carrier, the rotation means on the ring sections projecting through the openings.

11. A display device as claimed in claim 10 wherein the rotation means comprise radially extending lugs on the outer surface of the ring sections, the lugs extending above the cover.

* * * * *